United States Patent [19]

Misono et al.

[11] 4,403,170

[45] Sep. 6, 1983

[54] COLOR PICTURE TUBES

[75] Inventors: Masayoshi Misono, Choseimura; Masatoshi Akiyama, Yotsukaidomachi; Shigemi Hirasawa, Mobara, all of Japan

[73] Assignee: Hitachi, Ltd., Tokyo, Japan

[21] Appl. No.: 188,747

[22] Filed: Sep. 19, 1980

[30] Foreign Application Priority Data

Sep. 21, 1979 [JP] Japan ..... 54-120675

[51] Int. Cl.[3] ..... H01J 29/88

[52] U.S. Cl. ..... 313/479

[58] Field of Search ..... 313/479

[56] References Cited

U.S. PATENT DOCUMENTS

| | | | |
|---|---|---|---|
| 3,792,300 | 2/1974 | Benda et al. | 313/479 X |
| 4,251,749 | 2/1981 | Compen et al. | 313/479 |
| 4,272,701 | 6/1981 | Gallaro et al. | 313/479 |

FOREIGN PATENT DOCUMENTS

| | | | |
|---|---|---|---|
| 2806033 | 8/1979 | Fed. Rep. of Germany | 313/479 |
| 55-1010 | 1/1980 | Japan | 313/479 |

*Primary Examiner*—Eugene La Roche

*Attorney, Agent, or Firm*—Antonelli, Terry & Wands

[57] ABSTRACT

There is disclosed a color picture tube of the type having inner and outer conductive films respectively formed on inner and outer surfaces of a glass bulb of the color picture tube and a conduction path formed in the inner conductive film which extends from an anode terminal provided for the outer surface of the glass bulb to an electron gun for applying thereto anode high voltage. In this type of color picture tube, the resistance of the conduction path extending from the anode terminal to the electron gun is made smaller than an average resistance of a portion of the inner conductive film excepting the conduction path. With this arrangement, sufficient arcing energy can be obtained for removing causes for arcing when spot knocking involved in the manufacture process for the color picture tube is carried out and in addition, flash-over current accruing from arcing taking place during actual operation of a color television receiver set incorporating the color picture tube can be suppressed.

10 Claims, 16 Drawing Figures

COLOR PICTURE TUBES

The present invention relates to color picture tubes and more particularly to a color picture tube which is improved in withstand voltage characteristics for improving the reliability of television receiver sets.

Typically, a color picture tube comprises, as shown in FIG. 1*a* in back view and in FIG. 1*b* in upper view, a glass bulb including a funnel 1, a neck tube 2 and a panel 3, an anode terminal 4, an outer conductive film 5, an inner conductive film 6, and a shadow mask 7. The anode terminal 4 provided for the outer surface of the funnel 1 is connected to a lead wire (not shown) extending from an anode high voltage source. The anode terminal 4 passes through the wall of funnel 1 for connection to the inner conductive film 6 coated on the inner surface of the funnel 1. A resilient conductive spring is mounted to one of electron gun electrodes (not shown) which is applied with anode high voltage, for example, a sixth grid electrode (or a shield cup). The tip of the resilient conductive spring makes resilient contact to the surface of the inner conductive film 6 for application of the anode high voltage to the electron gun. Thus, the anode high voltage supplied to the anode terminal 4 is fed to the electron gun electrode via the inner conductive film 6 and the resilient conductive spring. The outer conductive film 5 coated on the outer surface of the funnel 1 and opposing a large area of the inner conductive film 6 is separated therefrom by the glass wall of the funnel 1 as shown in FIG. 1*b* to form an electrical capacitor. Consequently, between the anode terminal 4 connected to the inner conductive film 6 and the outer conductive film 5, there exists an extremely large electrostatic capacitance of, for example, about 2,000 pF which serves as a smoothing capacitor for the anode high voltage source. The smoothing capacitor is shown at 14 in FIG. 2.

Diagrammatically shown in FIG. 2 is an anode circuit of a color television receiver set incorporating such a color picture tube. When a pulse voltage 8 accrueing from an electrical oscillation usually generated when the horizontal deflection current is cut off is applied across the primary coil of a flyback transformer 9, high voltage is induced across the secondary coil. This high voltage is coupled to the anode terminal 4 via a rectifier 10. Electrically, the inner conductive film 6 is a resistor and for convenience of discussion, this resistor can be divided into a segmental resistor 11 of a portion of film 6 near the anode terminal 4, a segmental resistor 12 of another portion of film 6 which constitutes one electrode, extremely large in area, of the capacitor 14 which is grounded, the resistor 12 branching from a conduction path extending from the anode terminal 4 to the electron gun, and a segmental resistor 13 of the remaining portion of film 6 near the electron gun. The electron beam flow in the electron gun is considered an equivalent resistor 15 of the order of several mega ohms which is coupled to a grounding conductor 16 having an inductance of about 1 $\mu$H. The interspace between electron gun electrodes at which arcing tends to occur is represented by a gap 17. A spatial resistance across the gap 17 becomes minimal once the arcing takes place. It will be appreciated from FIG. 2 that the capacitor 14 can serve as a smoothing capacitor for the anode high voltage source. The anode high voltage is 25 to 30 KV.

FIG. 3 shows waveforms of currents grounding via the inductance 16 when arcing occurs across the gap 17 (for example, across the fourth or sixth grid electrode and the remaining electrodes of the electron gun), where the ordinate represents current and the abscissa time. In the figure, curve 18 corresponds to current flow caused when arcing occurs in a typical, conventional color picture tube and curve 19 corresponds to current flow caused when the resistance of the inner conductive film 6 is increased as will be described later. The current as represented by curve 18 rises up to a peak $i_o$ of 1,000 A so that a high voltage is induced across the inductance 16. This high voltage will interfere with a signal circuit of the television receiver set and it will sometimes break down the receiver set. The color picture tube incorporated in the television receiver set is not so sensitive to arcing caused during operation as to be damaged seriously.

Since current of several mA at the most is allowed to flow from the flyback transformer 9 through the rectifier 10, the peak flash-over current $i_o$ rising up to 1,000 A is mainly due to discharge of electrical charge stored in the capacitor 14 established between the inner and outer conductive films. Accordingly, when the capacitor 14 discharges to cause the arcing to take place, the anode circuit takes an equivalent circuit as shown in FIG. 4. In this figure, a switch 20 corresponds to the gap 17 in FIG. 2. Upon occurrence of the arcing, the voltage drop across the gap is about 50 V at the most and this electrical state is substantially equivalent to closure of the switch 20. In order to protect the television receiver set from damage by the high voltage developing across the inductance 16, it is necessary to decrease the peak $i_o$ of flash-over current shown in FIG. 3. To this end, the resistance of at least the segmental resistor 12 of the inner conductive film is required to be increased. By this measure, the flash-over current can be of a waveform as represented by curve 19 in FIG. 3 which has a decreased peak $i_1$ and which is non-oscillatory.

The manufacturing process of color picture tubes, on the other hand, includes a step called spot knocking. Parts of the electron gun for use in the color picture tube are subject to machining such as for example barrel polishing (tumbling) to ensure that irregular unevenness or projections on these parts can be removed; otherwise, electric field is concentrated at these projections. During assembling, however, welding is employed, which is liable to cause projections, and in addition, it is difficult to completely prevent deposition of dust onto the parts even when precautions are taken to ensure that everything is carefully cleaned. With the presence of projections and dust, arcing tends to occur in operation and the television receiver set may possibly be damaged.

Accordingly, spot knocking is employed after completion of sealing and evacuation of the bulb of color picture tube. In spot knocking, an anode voltage which is about three times as large as the normal anode voltage for operating the television receiver set is applied, so that intentional arcing is generated at sites at which arcing is critical due to irregular projections and dust deposits. The intentional arcing has sufficient energy to burn out the projections and contaminants. A circuit for carrying out spot knocking is diagrammatically shown in FIG. 5 in which the same elements as those in FIG. 2 are designated by the same reference numerals. Spot knocking is involved in the mass production process of color picture tubes and is usually carried out while conveying the color picture tube on a conveyor exclusively used for spot knocking. Voltage from a pulse source 21 is applied to a high voltage transformer 22 and boosted thereat to a voltage of several tens of kilo volts. This boosted voltage is then fed to the anode terminal 4 via a rectifier 23, a protective resistor 24 (typically, of several tens of mega ohms) and a feeder. The feeder is elongated to allow spot knocking for the color picture tube carried on the conveyor. The inner conductive film 6 has already been coated before spot knocking following sealing and evacuation of the bulb of color picture tube but coating of the outer conductive film 5 is not yet completed. Accordingly, the capacitor 14, which is established between the inner and outer conductive films, does not yet exist during spot knocking. However, a stray capacitance 25 between the inner conductive film and feeder and ground plays the part of the capacitor 14 and a high voltage electric charge is stored in the capacitance 25. When arcing takes place in the color picture tube, energy stored in the stray capacitance 25 is discharged and current flows mainly through segmental resistors 11 and 13 to burn out the irregular projections and contaminants at the arcing sites. Since segmental resistor 12 not shown in FIG. 5 has a relatively high resistance, current passed through the segmental resistor 12 is negligible as compared to the current passed through the segmental resistors 11 and 13. In this manner, the causes for arcing generation are mitigated and the withstand voltage level of the electron gun is improved. Metallic vapor or gas created by arcing within the color picture tube during spot knocking is absorbed by getters and the cooled bulb wall, thus preventing decrease in vacuum degree within the bulb. Since the signal circuit is disconnected from the color picture tube during spot knocking, the high voltage induced across a feeder inductance 26 raises no serious problem.

As will be seen from the foregoing description, spot knocking is employed for protecting the television receiver set from breakage due to arcing taking place in operation. But effective spot knocking is not carried out if the resistance of the segmental resistors 11 and 13 of the inner conductive film are high, because arcing energy produced from spot knocking arcing is consumed in the high resistances thereby failing to burn out the projections and contaminants completely.

For a number of samples of color picture tubes the dark current $i_d$ which flows past electrodes under the application of high voltage to the anode electrode was measured. Results are shown in FIG. 6. As shown, the dark current is distributed as represented by curve 27 when resistances of the segmental resistors 11 and 13 of the inner conductive film are low and as represented by curve 28 when those resistances are high. Curve 28 shows large values and a broad distribution of the dark current. The broad distribution proves that for individual samples, irregularity in dark current is large when the segmental resistors 11 and 13 have high resistances. These samples of color picture tubes were incorporated in a television receiver set and actually operated for one hour to examine the distribution of the generation frequency of arcings. Results are shown in FIG. 7 in which distribution curve 29 is for samples related to curve 27 in FIG. 6 (obtained when the resistances of the inner conductive film segmental resistors 11 and 13 are low) and distribution curve 30 is for samples related to curve 28 in FIG. 6 (obtained with high segmental resistors 11 and 13). Curves in FIG. 7 prove that the high resistances of the inner conductive film decrease the arcing energy produced from arcing generation, resulting in insufficient removal of the irregular projections and contaminants or so-called insufficient conditioning and consequent decrease in withstand voltage level of the products. Therefore, it is disadvantageous to increase the resistances of the segmental resistors 11 and 13 of the inner conductive film.

The present invention contemplates to solve the above problems and has for its object to provide a color picture tube which can decrease the flash-over current produced from arcing generation in actual operation of a color television receiver set incorporating the color picture tube to thereby protect the receiver set from damage and which can provide spot knocking with generation of sufficiently large energy for burning out such causes as irregular projections and contaminants for arcing generation during actual operation of the receiver set, to thereby maintain a sufficiently high withstand voltage level.

To accomplish the above object, the present invention is based on the fact that energy stored in the capacitor 14 established between the inner and outer conductive films is discharged to the arcing generating sites during actual operation of the television receiver set as will be seen from FIG. 2 whereas energy stored in the stray capacitance 25 between the feeder and ground is discharged during spot knocking, and according to the present invention, the resistance of a conduction path in the inner conductive film extending from the anode terminal to the electron gun is made smaller than an average resistance of a portion of the inner conductive film excepting the conduction path, that is, a portion constituting one electrode of the capacitor 14. The average resistance is equivalent to the segmental resistor 12 in FIG. 2. Thus, the relatively small resistance of the conduction path extending from the anode terminal to the electron gun ensures effects of spot knocking, and the relatively large resistance of the segmental resistor 12 sufficiently suppresses energy discharge produced from arcing generation during actual operation of the receiver set and reduces the flash-over current. An excessively high resistance of the segmental resistor 12 will disturb equipotential lines on the inner surface of the funnel 1 during actual operation and is unpractical.

Other objects, features and advantages of the present invention will become apparent from the following description taken in conjunction with the accompanying drawings in which:

FIG. 1*a* is a back view of one example of a color picture tube;

FIG. 1*b* is an upper view of the color picture tube shown in FIG. 1*a;*

Figure 8A:
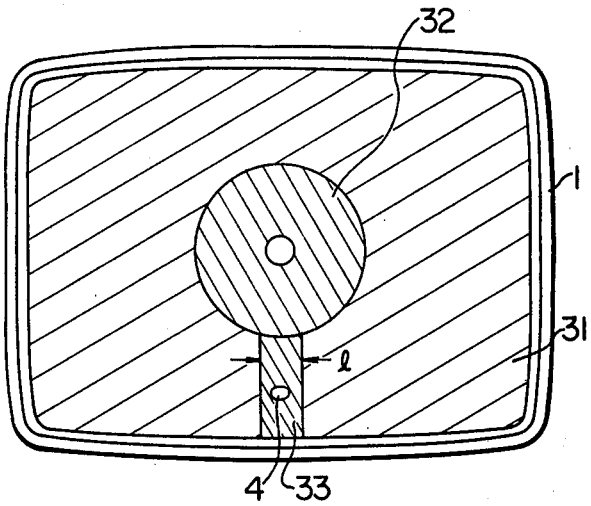
Figure 8B:
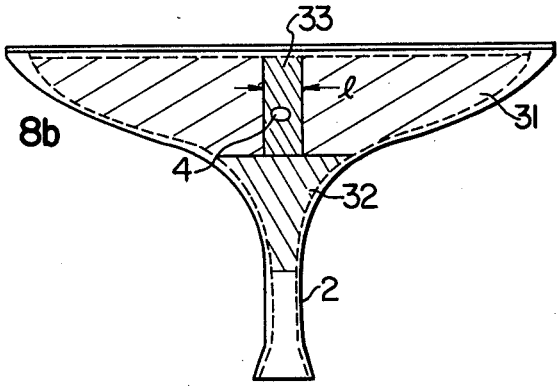
Figure 9A:
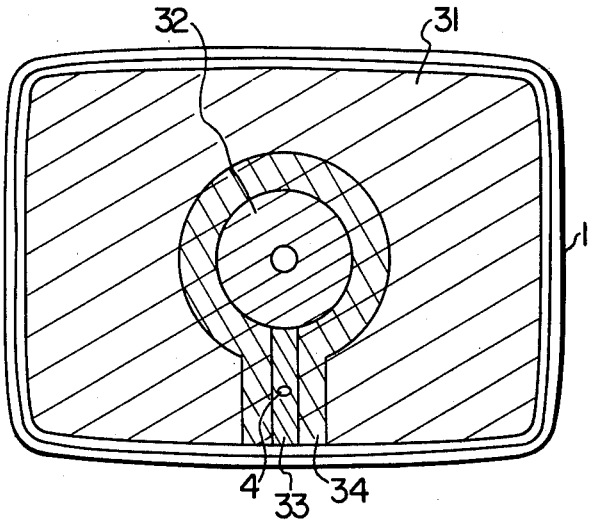
Figure 9B:
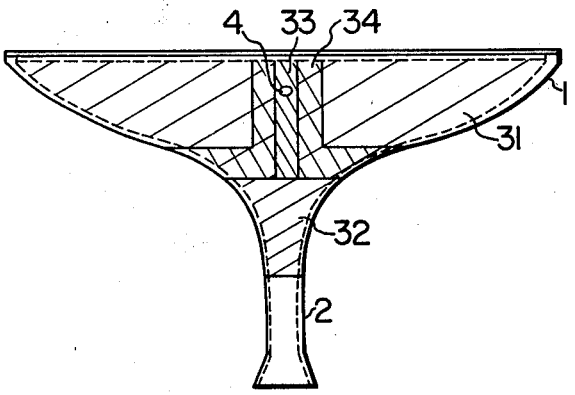

FIG. 8*a* is a plan view of a color picture tube embodying the present invention;

FIG. 8*b* is an upper view of the color picture tube shown in FIG. 8*a;* and FIGS. 9*a* and 9*b,* FIGS. 10*a* and 10*b* and FIGS. 11*a* and 11*b* show modified embodiments of the present invention, respectively.

Figure 1A:
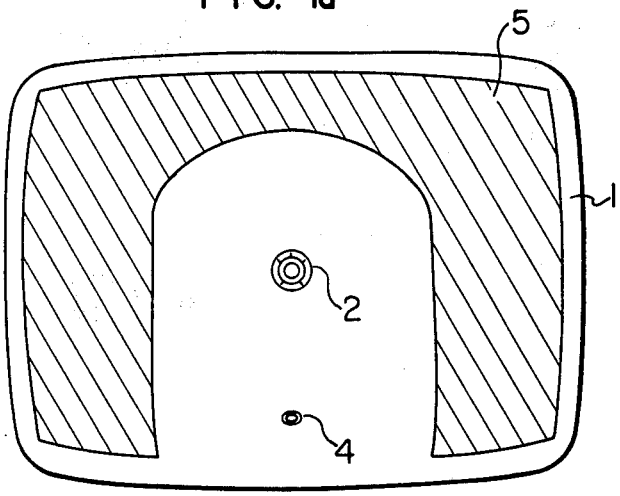
Figure 1B:
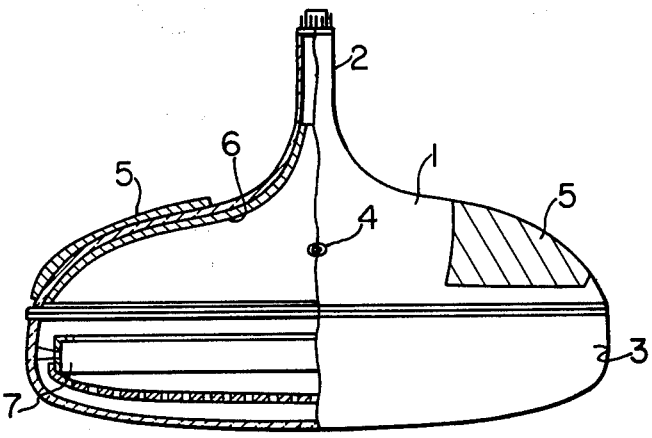
Figure 2:
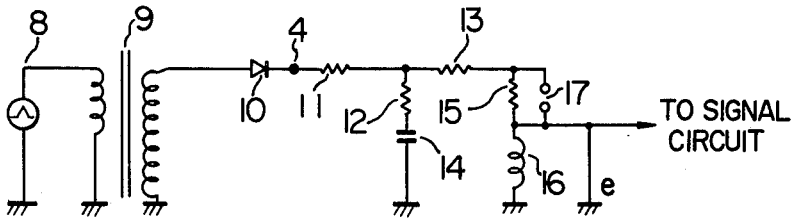
FIG. 2 is a schematic circuit diagram of an anode circuit of a television receiver set incorporating the color picture tube.
Figure 3:
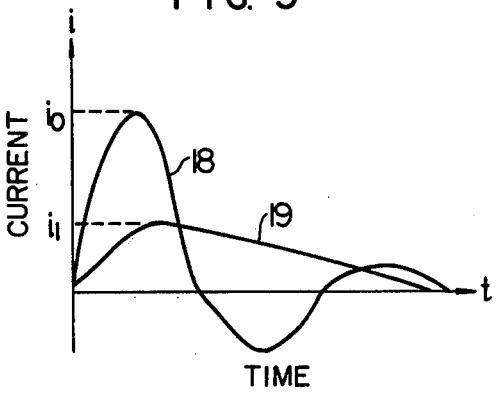
FIG. 3 is a graph showing flash-over current waveforms.
Figure 4:
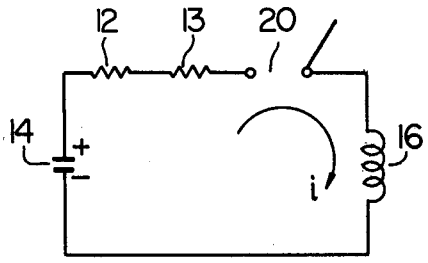
FIG. 4 is a circuit diagram of an equivalent anode circuit when arcing occurs during actual operation of the television receiver set.
Figure 5:
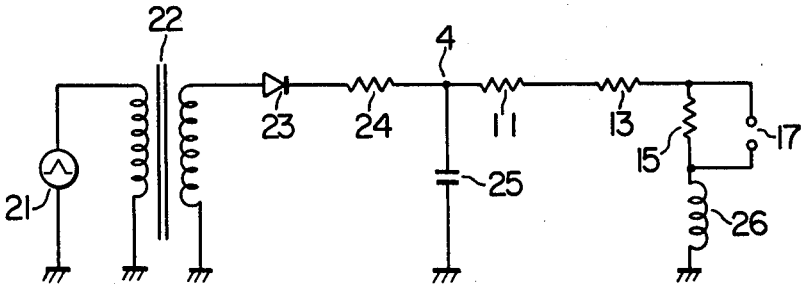
FIG. 5 is a schematic circuit diagram of an anode circuit when spot knocking is carried out.

The inner surface of a funnel 1 is coated with an inner conductive film according to the present invention as shown in FIGS. 8*a* and 8*b*. In a color picture tube, coating of the inner conductive film on the inner surface of funnel 1 may easily be accomplished before sealing together panel 3 and funnel 1 by frit glass following formation of a phosphor screen on the panel 3. A portion 31 of the inner conductive film has a relatively high resistance and as will be seen from FIG. 1, this portion mainly opposes the outer conductive film to constitute the capacitor 14 shown in FIG. 2. The segmental resistor 12 of the inner conductive film shown in FIG. 2 is made from the film of this portion 31 and hence, for the purpose of suppressing the flash-over current during actual operation, this film portion is required to have a relatively high resistance which in turn is effective to obtain a low peak flash-over current curve similar to curve 19 shown in FIG. 3. Another portion 32 of the inner conductive film is coated near the electron gun, from which portion is made the segmental resistor 13 shown in FIGS. 2 and 5. Accordingly, this portion is required to have a relatively small resistance. Near the anode terminal 4 is coated a remaining portion 33 of the inner conductive film having a relatively small width l and being in continuation to the portion 32. The remaining portion 33 corresponds to the segmental resistor 11 shown in FIGS. 2 and 5 and is required to have a relatively small resistance. From the standpoint of mass production, it is preferable that the conductive material of the inner conductive film mainly contain graphite which has long been used as a material for this type of film. A material of 0.5 to 5000 Ωcm resistivity is coated to form the film portion 31 having a surface resistance 500 to 50,000 Ω/□ and a material of 0.001 to 10 Ωcm resistivity is coated to form the film portions 32 and 33 having a surface resistance of 1 to 500 Ω/□. Surface resistance and the width l of the film portion 33 are desirably dimensioned dependent on conditions for spot knocking and allowable value of the flash-over current during actual operation of the television receiver set.

Figure 6:
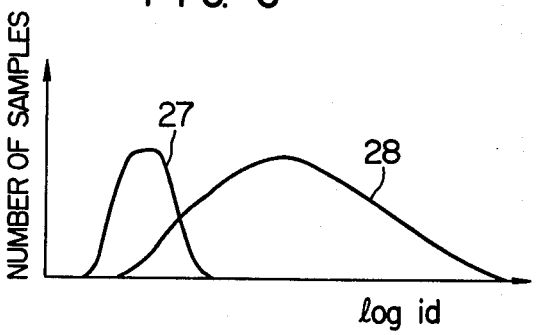
FIG. 6 is a graph showing dark current distributions for a number of samples of color picture tubes.
Figure 7:
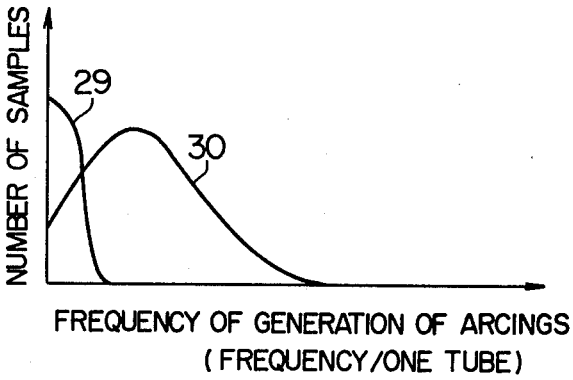
FIG. 7 is a graph showing distributions of frequency of arcings generated in one color picture tube in samples of FIG. 7 when the one color picture tube is incorporated in the television receiver set and actually operated for one hour.

With this embodiment, good results were obtained under the following conditions for spot knocking. For knocking voltage being 40 to 65 KV, resistivity of film portion 31 being 2.5 Ωcm, resistivity of film portion 32 being 0.3 Ωcm, resistivity of film portion 33 being 0.05 Ωcm and width l being 30 mm, the dark current distribution was determined by $\bar{x} \doteqdot 100$ nA and $\bar{x}+\sigma=250$ nA, where $\bar{x}$ is a median and $\sigma$ a standard deviation in a logarithmic normal distribution shown in FIG. 6. For faulty products, $\bar{x}+\sigma \doteqdot 1000$ nA. The peak of flash-over current during actual operation was drastically decreased from 600 A/$E_b$=25 KV ($E_b$: anode voltage) of the prior art product to 50 A/$E_b$=25 KV of this embodiment.

The conduction path extending from the anode terminal to the electron gun for application thereto of the anode high voltage and consisting of the low resistance inner conductive film portions 32 and 33 made of graphite in this embodiment may be replaced by metal films in order to reduce the resistance. Alternatively, the conduction path may partly or entirely be made from a metal strap. Also, to maintain high vacuum within the bulb, a flash getter mainly containing Ba, which is inexpensive and easy to handle, is used in the color picture tube as mentioned hereinbefore. A getter film resulting from the flash getter is highly conductive and if the getter film is deposited on the high resistance film portion 31, the effect of different coatings of different resistance film portions is lost. To avoid such a trouble, it is necessary to provide an inner shield, to use a highly orientated getter or to precisely control the direction of getter flashing.

A modified embodiment of the present invention as shown in FIGS. 9*a* and 9*b* comprises a high resistance, porous film 34. In FIGS. 9*a* and 9*b,* the same elements as those shown in FIGS. 8*a* and 8*b* are designated by the same reference numerals. By virtue of the high resistance, porous film 34, even when a getter film is formed within a region in which the getter film electrically bridges or short-circuits the low resistance film portions 32 and 33 and the high resistance film portion 31, the area of the film portions 32 and 33 will not extend to the film portion 31, thereby substantially maintaining the high resistance of the film portion 31. Thus, the high resistance of the segmental resistor 12 shown in FIG. 2 can be maintained. The porous film may be a mixture of a vitreous material of slight fluidity, such as vacuum cement containing, for examples 15 wt% $SiO_2$, 5 wt% $Na_2O_2$ and water, and a small amount of conductive material.

Figure 10A:
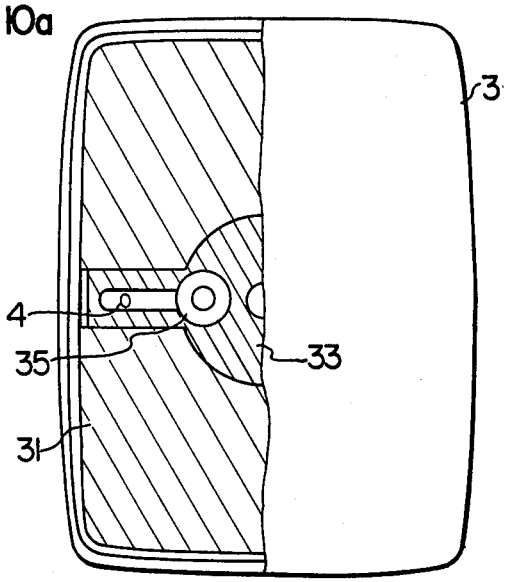
Figure 10B:
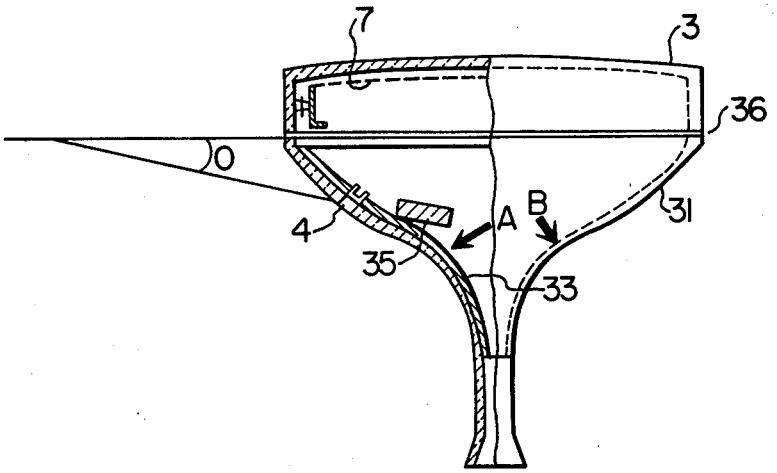

FIGS. 10*a* and 10*b* show another modified embodiment of the present invention, in which the same element as those of FIGS. 8*a* and 8*b* are designated by the same reference numerals. In the figures, a getter holder 35 is provided for housing a getter material. The getter material to maintain vacuum within the color picture tube is vapor deposited on the bulb wall after completion of evacuation and sealing of the bulb. If a large amount of getter material is deposited near points A and B shown in FIGS. 8*a* and 8*b,* the resistance of the segmental resistor 12 shown in FIG. 2 is decreased. To avoid such a problem, according to this embodiment, the getter holder 35 is oriented toward the shadow mask 7. Experiments show that a preferable range of an angle between the upper surface of the getter holder and the sealed boundary of the panel and funnel is from 0° to 60°. With the angle being less than 0°, high frequency inductive heating for vaporizing the getter material becomes difficult to perform and with the angle being more than 60°, the resistance of the segmental resistor 12 shown in FIG. 2 is reduced and hence the peak of flash-over current during actual operation of the television receiver set is increased.

Figure 11A:
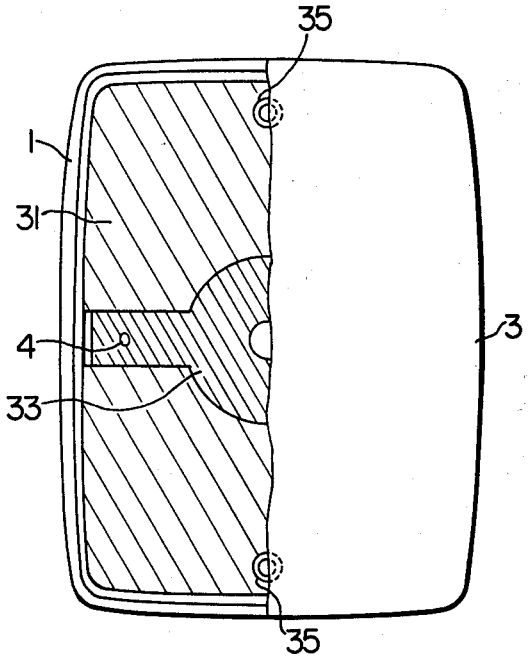
Figure 11B:
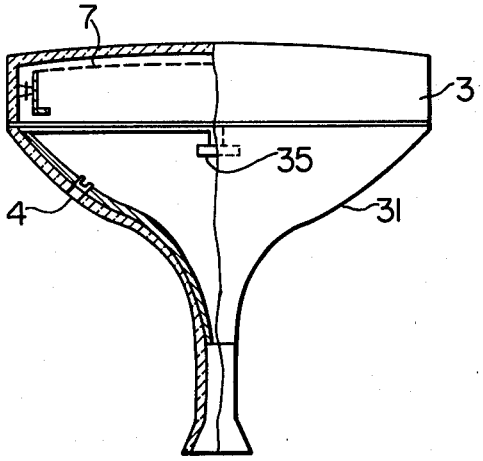

FIGS. 11*a* and 11*b* show still another modified embodiment of the present invention which is directed to restrict the area at which the getter film is formed. In the figures, the same elements as those of FIGS. 8*a* and 8*b* are designated by the same reference numerals. In order to prolong the life of the color picture tube, it is important to place the cathode of the electron gun in good condition for emitting electrons. Such ability to emit electrons depends on the structure and material of the cathode as well as the vacuum degree within the bulb of a color picture tube. Therefore, it is desirable for the getter film to cover as large an area as possible on the inner surface of the bulb. However, formation of getter films in many places on the inner surface of the bulb will decrease the resistance of the segmental resistor 12 shown in FIG. 2. To solve this problem, according to this modification, a plurality of getters are arranged in a manner as shown in FIGS. 11*a* and 11*b*. One getter material is first vaporized so that the vacuum degree within the bulb is improved by absorption of the one getter. Under this condition, when the other getter material is vaporized, gas stemming from vaporization of the other getter material is absorbed by a getter film made from the first vaporized getter material, thereby assuring the required vacuum degree within the bulb. The direction of vaporization of getter material is sharply orientated and the area of deposited getter film can be restricted. As a result, by using a plurality of getter materials, it is possible to form islands of getter films which are distributed to desired sites on a wide area of the inner surface of the bulb.

As has been described, the present invention can maintain the high withstand voltage level by discharging sufficiently large energy to arcing generation sites during spot knocking and in addition, decrease flashover current accruing from arcing taking place during actual operation of the television receiver set incorporating the color picture tube, thereby preventing the television set from being damaged.

What is claimed is:

1. In a color picture tube comprising inner and outer conductive films respectively formed on inner and outer surfaces of a glass bulb of the color picture tube, and a conduction path formed in the inner conductive film which extends from an anode terminal provided for the outer surface of the glass bulb to an electron gun for applying thereto an anode high voltage, the improvement wherein the conduction path extending from the anode terminal to the electron gun has a resistance which is smaller than the average resistance of a portion of the inner conductive film excepting the conduction path.

2. A color picture tube according to claim 1 wherein the resistance of the conduction path extending from the anode terminal to the electron gun is 1 to 500 Ω/□ in terms of surface resistance, and the resistance of the portion of the inner conductive film excepting the conduction path is 500 to 50,000 Ω/□ in terms of surface resistance.

3. A color picture tube according to claim 1 or 2 wherein a high resistance, porous film is coated between the conduction path extending from the anode electrode and said portion of the inner conductive film.

4. A color picture tube according to claim 1 or 2 which further comprises a getter holder arranged above the conduction path extending from the anode terminal to the electron gun and having its upper surface inclined by an angle of from 0° to 60° with respect to a sealed boundary of a panel and a funnel of the bulb.

5. A color picture tube according to claim 1 or 2 which further comprises a plurality of getter materials mounted to the inner surface of the glass bulb, for forming islands of getter films on predetermined areas on the inner surface of the bulb.

6. A cathode ray tube comprising an evacuated glass bulb having a neck portion at one end thereof, a panel portion at the other end thereof and an interconnecting funnel portion;

a screen disposed on the inner surface of said panel portion and an electron gun disposed in said neck portion facing said screen;

an anode terminal extending through the wall of said glass bulb in the funnel portion thereof for supplying an anode high voltage; and inner and outer conductive films respectively formed on the inner and outer surfaces of at least said funnel portion of said glass bulb, said inner conductive film including a first portion in conductive contact with and extending from said anode terminal to said neck portion in the vicinity of said electron gun and having a first resistivity and a second portion extending over substantially the remainder of the inner surface of said funnel portion and having a second resistivity which is higher than said first resistivity.

7. A cathode ray tube according to claim 6 wherein said first portion of said inner conductive film is a strip-like portion forming a conduction path having a resistance which is smaller than the average resistance of said second portion of said inner conductive film.

8. A cathode ray tube according to claim 6 wherein said first portion of said inner conductive film at least partially covers the inner surface of said neck portion of said glass bulb.

9. A cathode ray tube according to claim 6 wherein said second portion of said inner conductive film includes a strip-like part in the form of a high resistance porous film disposed between said first portion of said inner conductive film and the remainder of the second portion thereof.

10. In a cathode ray tube having a glass bulb including a neck portion in which an electron gun is disposed and a funnel portion in which an anode terminal is provided to supply anode high voltage; the improvement comprising inner and outer conductive films respectively formed on the inner and outer surfaces of at least said funnel portion of said glass bulb, said inner conductive film comprising means forming a conduction path having a first resistance and extending from contact with said anode terminal to said neck portion in the vicinity of said electron gun and a conductive film portion having an average resistance which is greater than said first resistance and extending over substantially the remainder of the inner surface of said funnel portion.

* * * * *